US008813645B2

(12) United States Patent
Kündgen et al.

(10) Patent No.: US 8,813,645 B2
(45) Date of Patent: Aug. 26, 2014

(54) PRINTING PRESS WITH CYLINDER ADJUSTMENT AND CONTROL DEVICES

(75) Inventors: Rolf Kündgen, Bad Schönborn (DE); Siegfried Kurtzer, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 236 days.

(21) Appl. No.: 12/940,283

(22) Filed: Nov. 5, 2010

(65) Prior Publication Data

US 2011/0100240 A1 May 5, 2011

(30) Foreign Application Priority Data

Nov. 5, 2009 (DE) ..... 10 2009 052 095

(51) Int. Cl.
*B41F 13/24* (2006.01)
*B41F 13/34* (2006.01)
*B41F 13/36* (2006.01)

(52) U.S. Cl.
USPC ..... 101/248; 101/216; 101/247

(58) Field of Classification Search
USPC ..... 101/248, 216, 485, 247
See application file for complete search history.

(56) References Cited

U.S. PATENT DOCUMENTS

| | | | |
|---|---|---|---|
| 6,085,651 A | 7/2000 | Defrance et al. | |
| 7,934,450 B2 | 5/2011 | KÜNdgen et al. | |
| 8,042,467 B2 | 10/2011 | Schaffrath et al. | |
| 2007/0221075 A1 * | 9/2007 | Kundgen et al. | 101/218 |

FOREIGN PATENT DOCUMENTS

| | | |
|---|---|---|
| CN | 1235087 A | 11/1999 |
| CN | 101041285 A | 9/2007 |
| CN | 101391506 A | 3/2009 |
| DE | 86 631 | 12/1971 |
| DE | 41 42 755 A1 | 6/1993 |
| DE | 197 01 216 A1 | 7/1998 |
| DE | 10 2007 009 884 A1 | 9/2007 |
| GB | 2244676 A | 12/1991 |

OTHER PUBLICATIONS

German Patent and Trademark Office Search Report, Dated Aug. 5, 2010.

* cited by examiner

*Primary Examiner* — Ren Yan
*Assistant Examiner* — Justin Olamit
(74) *Attorney, Agent, or Firm* — Laurence A. Greenberg; Werner H. Stemer; Ralph E. Locher

(57) ABSTRACT

A printing press includes a printing form cylinder, a blanket cylinder, an impression cylinder, an adjusting device for setting a printing pressure between the blanket cylinder and the impression cylinder, a control device for throwing the pressure of the blanket cylinder on and off relative to the impression cylinder and springs for producing bearer ring pressure between bearer rings of the printing form cylinder and bearer rings of the blanket cylinder. The springs are integrated into coupling links and are connected to at least one of the two devices in such a way that, as a result of the actuation of that device, the springs are also adjusted, in order to keep the bearer ring pressure at least substantially constant.

7 Claims, 2 Drawing Sheets

PRINTING PRESS WITH CYLINDER ADJUSTMENT AND CONTROL DEVICES

CROSS-REFERENCE TO RELATED APPLICATION

This application claims the priority, under 35 U.S.C. §119, of German Patent Application DE 10 2009 052 095.3, filed Nov. 5, 2009; the prior application is herewith incorporated by reference in its entirety.

BACKGROUND OF THE INVENTION

Field of the Invention

The present invention relates to a printing press, including a printing form cylinder, a blanket cylinder, an impression cylinder, an adjusting device for setting an impression setting or printing pressure between the blanket cylinder and the impression cylinder, a control device for throwing the pressure of the blanket cylinder on and off relative to the impression cylinder and springs for producing a bearer ring (Schmitz ring) pressure between bearer rings of the printing form cylinder and bearer rings of the blanket cylinder.

In German Published, Non-Prosecuted Patent Application DE 10 2007 009 884 A1, corresponding to U.S. Patent Application Publication No. US 2007/0221075 A1, a printing press having a tracking system is described. The tracking system includes two actuating drives which are connected through so-called spring legs to eccentric bearings, in which the impression cylinder is mounted. The two actuating drives have a control connection through an electronic control device to a further actuating drive. The further actuating drive is a constituent part of an adjusting device for setting the impression setting or printing pressure between the blanket cylinder and the impression cylinder. The electronic control device actuates the two actuating drives of the tracking system in order to set the impression setting between the printing form cylinder and the blanket cylinder, depending on the impression setting between the blanket cylinder and the impression cylinder, and thus also a pressure between bearer rings of the printing form cylinder and bearer rings of the blanket cylinder. The disadvantage of the electronic connection is its comparatively large susceptibility to interference. A possible malfunction can involve damage to the bearer rings and other components.

In German Patent DE 41 42 755 C2, a printing press is described in which the adjusting device for setting the impression setting between the blanket cylinder and the printing form cylinder is coupled through a mechanism to an adjusting device for setting the impression setting between the blanket cylinder and the impression cylinder. The mechanism includes a control cam, a cam roller and a compression spring, which is used to keep the cam roller in contact with the control cam. The printing form cylinder and the blanket cylinder are equipped with bearer rings. The compression spring is supported with its one end on the collar of a bushing and with its other end on the head of a retaining rod, which can be adjusted in the bushing. The head of the retaining rod is pressed by the compression spring against one arm of an angled lever, the other arm of which bears the cam roller. The disadvantage with the configuration of the compression spring is that the latter is not capable of keeping the bearer ring pressure constant to a sufficient extent.

SUMMARY OF THE INVENTION

It is accordingly an object of the invention to provide a printing press with cylinder adjustment and control devices, which overcomes the hereinafore-mentioned disadvantages of the heretofore-known devices of this general type and in which bearer ring pressure is kept constant in a manner that is not susceptible to interference and is provided to a sufficient extent.

With the foregoing and other objects in view there is provided, in accordance with the invention, a printing press, comprising a printing form cylinder having bearer rings, a blanket cylinder having bearer rings, an impression cylinder, an adjusting device for setting a printing pressure or impression setting between the blanket cylinder and the impression cylinder, a control device for throwing a pressure of the blanket cylinder on and off relative to the impression cylinder and coupling links having springs integrated therein for producing bearer ring pressure between the bearer rings of the printing form cylinder and the bearer rings of the blanket cylinder. A coupling mechanism connects the springs to at least one of the devices, for adjusting the springs as a result of an actuation of the at least one device, to keep the bearer ring pressure at least substantially constant.

As a result of the integration of the springs into the coupling links, the springs produce the bearer ring pressure and, as a result of the connection of the springs to the device through a coupling mechanism, tracking which is not susceptible to interference is ensured.

In accordance with another feature of the invention, the springs are coupled to the device through control cams.

In accordance with a further feature of the invention, the springs are coupled to the device through swinging arms.

In accordance with an added feature of the invention, the device with which the springs are coupled is the control device.

In accordance with a concomitant feature of the invention, the device with which the springs are coupled is the adjusting device.

Other features which are considered as characteristic for the invention are set forth in the appended claims.

Although the invention is illustrated and described herein as embodied in a printing press with cylinder adjustment and control devices, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
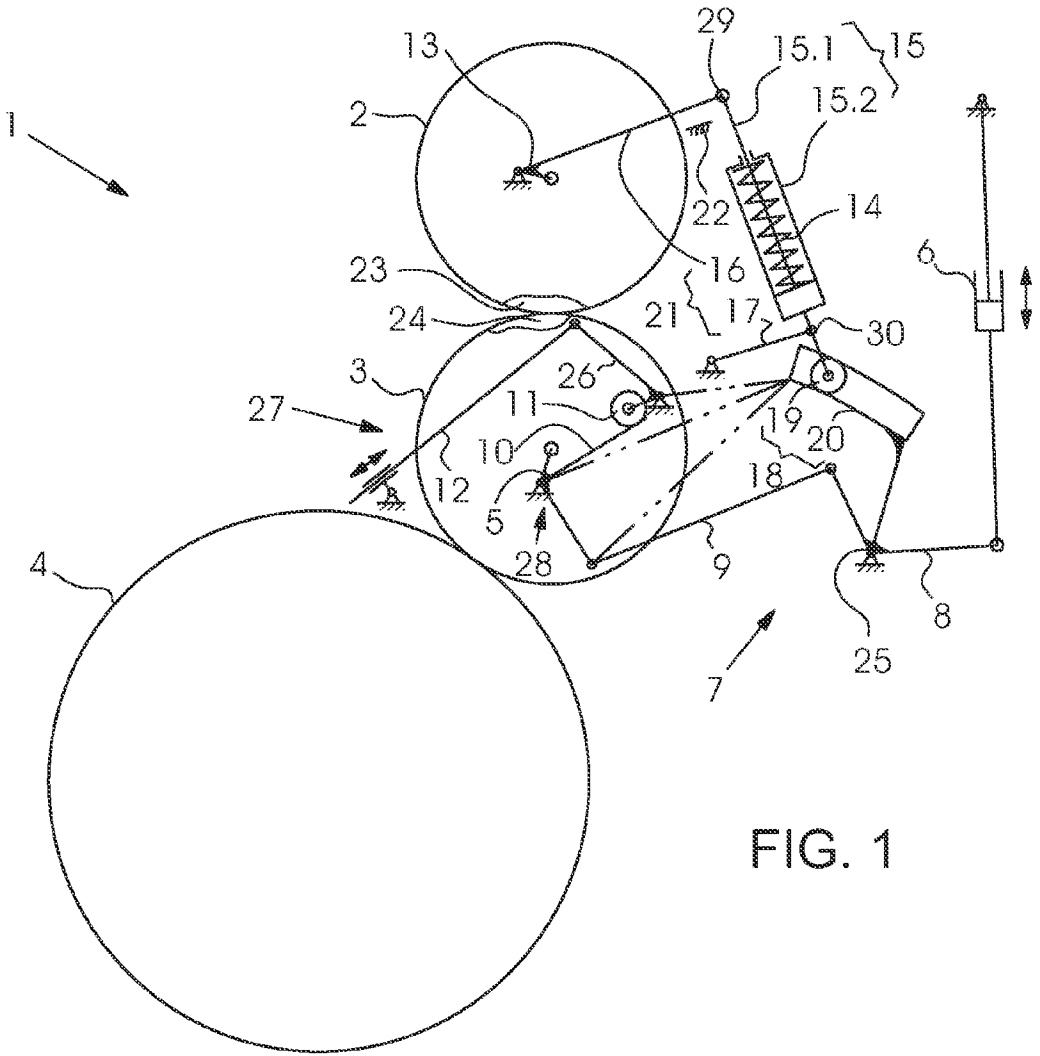
FIG. 1 is a diagrammatic, cross-sectional view of a portion of a first exemplary embodiment of a printing press, in which springs are coupled through control cams.

Referring now in detail to the figures of the drawings, in which mutually corresponding components and elements are designated by the same designations and first, particularly, to FIG. 1 thereof, there is seen a printing press 1 for lithographic offset printing on sheets of printing material. The printing press 1 includes a printing form cylinder 2, a blanket cylinder 3 and an impression cylinder 4. The blanket cylinder 3 is mounted in a first eccentric bearing 5. The blanket cylinder 3 can optionally be adjusted into a print-on position and a print-off position by adjusting the first eccentric bearing 5. The first eccentric bearing 5 is a constituent part of a control device 28 for switching pressure of the blanket cylinder 3 on and off relative to the impression cylinder 4. The adjustment of the eccentric bearing 5 is driven by a pneumatic operating cylinder 6 through a four bar mechanism 7.

The four bar mechanism 7 includes a double-armed drive swinging arm 8, a coupling link 9 and a double-armed output swinging arm 10. The drive swinging arm 8 has a first arm, on which the operating cylinder 6 acts, and a second arm, which is connected to the coupling link 9 in a rotationally articulated manner. The output swinging arm 10 has a first arm which, in the print-on position, rests on a first stop 11, and a second arm, which is connected to the coupling link 9 in a rotationally articulated manner. The first stop 11 is a roller and can be adjusted, specifically pivoted, manually or preferably by a motor, through a first coupling mechanism 12. The first stop 11 is disposed on a swinging arm 26 of the first coupling mechanism 12.

An impression setting is set as a result of the adjustment of the first stop 11, which is to say a size of a gap between the blanket cylinder 3 and the impression cylinder 4 or the pressure present in the gap is set. The stop 11 and the first coupling mechanism 12 are thus constituent parts of an adjusting device 27 for setting the impression setting or printing pressure between the blanket cylinder 3 and the impression cylinder 4.

The printing form cylinder 2 is mounted in a second eccentric bearing 13, which is loaded by a spring 14. The spring 14 is a constituent part of a variable length coupling link or coupler 15, which is assembled from a first rod piece 15.1 and a second rod piece 15.2. The second rod piece 15.2 is connected to the first rod piece 15.1 in a sliding or a telescopic manner. The spring 14, which can be loaded in compression, is a helical spring and is supported with its first spring end on the first rod piece 15.1 and with its second spring end on the second rod piece 15.2, in such a way that the spring 14 attempts to shorten the coupling link 15.

The coupling link 15 is connected to a first swinging arm 16 through a rotary joint 29 and has a drive connection to the eccentric bearing 13 provided through the first swinging arm 16. The coupling link 15 is connected to a second swinging arm 17 through a further rotary joint 30 and is supported on a machine frame through the second swinging arm 17. The coupling link 15, together with the swinging arms 16, 17, forms a second coupling mechanism 21.

The coupling link 15 is driven through a cam mechanism 18. A cam follower 19 in the form of a cam roller disposed on the coupling link 15, and a control cam 20 guiding the cam follower 19 and having a guide groove, belong to the cam mechanism 18. The control cam 20 can be fixed to an element of the four bar mechanism 7, for example to the drive swinging arm 8, as is illustrated by a solid line.

Phantom lines illustrate alternative fixed connections of the control cam 20 to the coupling link 9 or to the output swinging arm 10. In all of these variants, the control cam 20 is adjusted by the operating cylinder 6. However, the control cam 20 can also be fixed to an element of the first coupling mechanism 12, as is likewise illustrated by a phantom line. In the last-named case, the control cam 20 is adjusted by an operator manually or by a motor, in a manner which is not illustrated in the drawing.

A second stop 22 is used to limit the adjustment travel of the second eccentric bearing 13 in a first direction when moving the printing form cylinder 2 away from the blanket cylinder 3. In a second direction, the adjustment travel of the second eccentric bearing 13 is limited by a bearer ring 23 of the printing form cylinder 2 and a bearer ring 24 of the blanket cylinder 3 as a result of the fact that, when the printing form cylinder 2 is moved against the blanket cylinder 3, the bearer ring 23 of the printing form cylinder 2 comes into contact with the bearer ring 24 of the blanket cylinder 3.

It goes without saying that the bearer rings 23, 24 are disposed once at the ends of the cylinders on the drive side and a further time at the ends of the cylinders on the operating side of the printing press 1. Likewise, the first eccentric bearing 5, the second eccentric bearing 13, the four bar mechanism 7, the first coupling mechanism 12, the second coupling mechanism 21 and the cam mechanism 18 are in each case present in a dual configuration.

The operating cylinder 6 functions as a common drive for the four bar mechanism 7 disposed on the drive side and the four bar mechanism disposed on the operating side, due to these two four bar mechanisms being connected to each other through a synchronizer shaft 25. Accordingly, the operating cylinder 6 also effects the displacement movements of both first eccentric bearings 5, both cam mechanisms 18, both second coupling mechanisms 21 and both second eccentric bearings 13.

The illustrated mechanism functions in the following way: the springs 14 on the operating side and the drive side produce the desired pressure of the first bearer rings 23 against the second bearer rings 24. If the cam mechanisms 18 disposed on both machines sides were not present, an adjustment of the impression setting present in the press nip between the blanket cylinder 3 and the impression cylinder 4 would result in an undesired change in the pressure between the respective bearer ring 23 of the printing form cylinder 2 and the bearer ring 24 corresponding thereto and belonging to the blanket cylinder 3. The control cams 20 are contoured in such a way that, as a result of their cam contour, compensation for the undesired change in the bearer ring pressure is carried out by the positions of the coupling links 15 being changed.

Through the use of this adjustment of the coupling links 15, the base of the respective spring 14 is readjusted, so that the length of the respective coupling link 15 and thus the tension of the springs 14 is kept constant within the entire adjustment range of the impression setting. Either, in the case in which the control cams 20 are fixed to the first coupling mechanism 12, the control cams 20 are already moved during the adjustment of the impression setting through the use of an adjustment of the first stops 11 or, in the case in which the control cams 20 are fixed to the four bar mechanisms 7, the control cams 20 are moved only when printing is switched on, in such a way that, through the use of this movement, the cam followers 19 and thus the second rod pieces 15.2, which form the bases of the springs 14, are moved in the manner explained.

Figure 2:
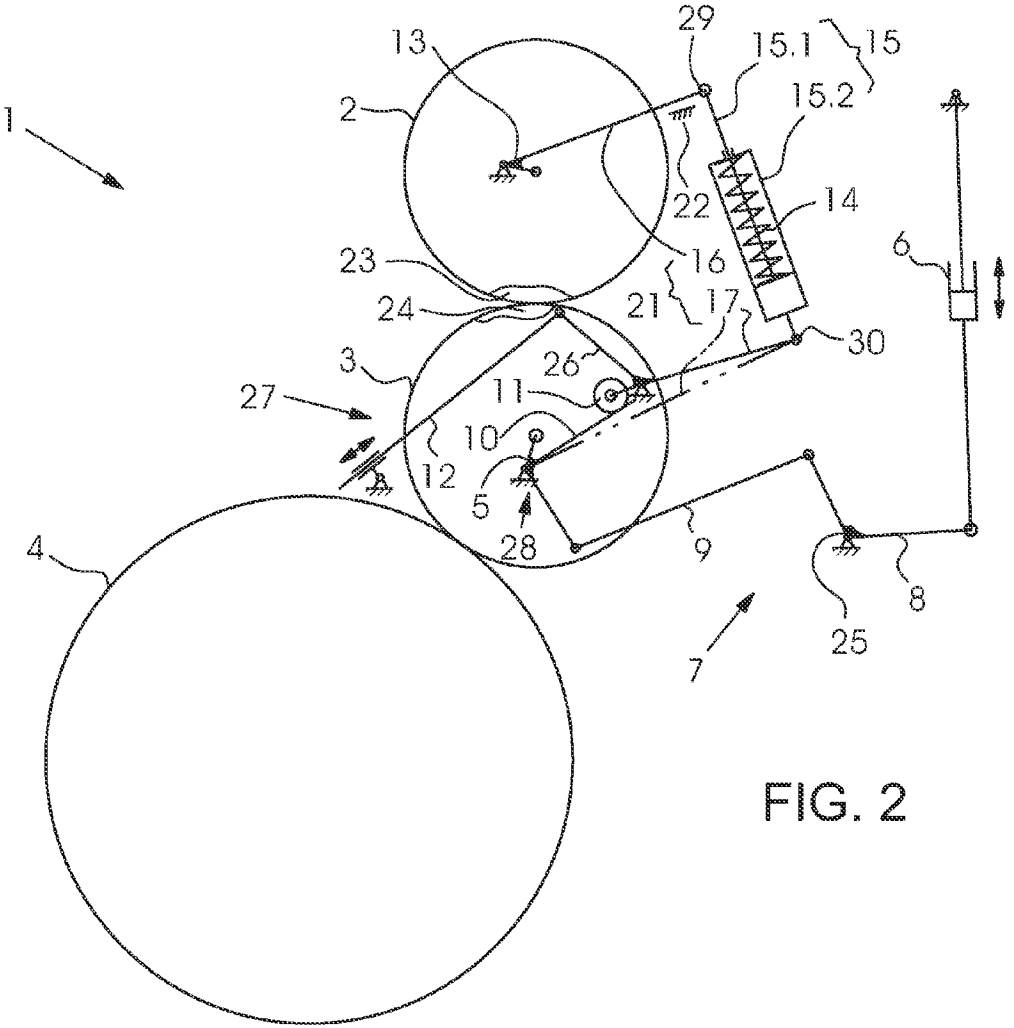
FIG. 2 is a cross-sectional view of a portion of a second exemplary embodiment of a printing press, in which springs are coupled through swinging arms.

FIG. 2 illustrates a modification of the printing press of FIG. 1. In this modification, the cam mechanisms 18 are dispensed with. Two coupling mechanism variants are shown, which make it possible, even without the cam mechanisms, to adjust the base of the spring 14 in the manner already explained and to keep the bearer ring pressure constant in the event of an enlargement or reduction in the impression setting.

In one variant, which is illustrated by a solid line in FIG. 2, the second swinging arm 17 forms a unit together with the swinging arm 26. The second swinging arm 17 forms a first lever arm and the swinging arm 26 forms a second lever arm of one and the same lever. In this variant, the coupling link 15 is attached to an element of the first coupling mechanism 12.

In the other variant, which is illustrated by a phantom line in FIG. 2, the coupling link 15 is attached to the first eccentric bearing 5 through the swinging arm 17. In both variants, the dimensions of the elements of the mechanisms, such as the lengths of the swinging arms and the joint spacings, are chosen in such a way that the coupling links 15 track the change in the impression setting in such a way that the tension of the springs 14 is kept substantially constant and thus the pressure between the bearer rings 23 of the printing form cylinder 2 and the bearer rings 24 of the blanket cylinder 3 is kept substantially constant.

The invention claimed is:

1. A printing press, comprising:

a printing form cylinder having bearer rings;

a blanket cylinder having bearer rings;

an impression cylinder;

devices, said devices including an adjusting device for setting a printing pressure between said blanket cylinder and said impression cylinder; and a control device for throwing a pressure of said blanket cylinder on and off relative to said impression cylinder;

variable length coupling links, each of said coupling links having a respective spring integrated therein for producing bearer ring pressure between said bearer rings of said printing form cylinder and said bearer rings of said blanket cylinder, each of said variable coupling links being directly coupled between swinging arms; and each said spring being mechanically coupled to at least one of said devices for relocating each said spring as a result of an actuation of said at least one of said devices, to keep the pressure at least substantially constant.

2. The printing press according to claim 1, which further comprises control cams coupling each said spring to said at least one of said devices.

3. The printing press according to claim 1, which further comprises swinging arms coupling each said spring to said at least one of said devices.

4. The printing press according to claim 1, wherein each said spring is coupled to said control device.

5. The printing press according to claim 1, wherein each said spring is coupled to said adjusting device.

6. The printing press according to claim 1, wherein said variable length coupling links are constructed from a first rod piece and a second rod piece which are connected to one another in a sliding or telescoping manner.

7. The printing press according to claim 1, wherein said variable length coupling links are directly connected to said swinging arms by rotary joints.

* * * * *